United States Patent [19]

Goodrich et al.

[11] Patent Number: 4,699,443

[45] Date of Patent: Oct. 13, 1987

[54] MODULAR TELEPHONE JACK

[75] Inventors: Robert R. Goodrich, Indianapolis, Ind.; Edmund N. Sepe, Ocean Township, Monmouth County, N.J.

[73] Assignees: American Telephone and Telegraph Company; AT&T Information Systems Inc.; AT&T Technologies, Inc., all of Murray Hill, N.J.

[21] Appl. No.: 863,364

[22] Filed: May 15, 1986

Related U.S. Application Data

[63] Continuation of Ser. No. 687,547, Dec. 28, 1984, abandoned.

[51] Int. Cl.[4] ..... H01R 13/71; H01R 23/10

[52] U.S. Cl. ..... 439/188; 200/51.06; 200/51.1; 439/676

[58] Field of Search ..... 339/17 LC, 147 R, 147 P, 339/176 M, 176 MP, 111; 200/51.04, 51.05, 51.06, 51.09, 51.1

[56] References Cited

U.S. PATENT DOCUMENTS

| | | | |
|---|---|---|---|
| 4,193,654 | 3/1980 | Hughes | 339/17 |
| 4,202,593 | 5/1980 | Abernethy et al. | 339/176 M |
| 4,210,376 | 7/1980 | Hughes et al. | 339/176 M |
| 4,224,485 | 9/1980 | Krumreich | 200/51.1 |
| 4,231,628 | 11/1980 | Hughes | 339/17 |
| 4,239,316 | 12/1960 | Spaulding | 339/176 M |
| 4,274,691 | 6/1981 | Abernethy et al. | 339/176 MP |

*Primary Examiner*—Gil Weidenfeld
*Assistant Examiner*—Gary F. Paumen
*Attorney, Agent, or Firm*—Harry L. Newman

[57] ABSTRACT

The invention relates to a modular jack for telephone equipment. The jack has a pair of switch contact springs which are activated only when a plug of a specific shape is inserted into the jack.

10 Claims, 8 Drawing Figures

MODULAR TELEPHONE JACK

This is a continuation of application Ser. No. 687547, filed Dec. 28, 1984, now abandoned.

INCORPORATION BY REFERENCE

The entire disclosure of U.S. Pat. No. 4,224,485, issued to C. L. Krumreich on Sept. 23, 1980, is hereby incorporated by reference.

1. Technical Field

The invention relates to the field of electrical connectors and within that field to modular jacks and plugs for making electrical connections with telephone equipment.

2. Background of the Invention

In general, prior art telephone jacks are limited in the ability to distinguish between different types of inserted plugs. Since plug type is a basis for selective feature activation, the prior art is correspondingly limited in the number of such alternative features and options that may be provided via the mechanisms. For example, U.S. Pat. No. 4,224,485 discloses a modular telephone jack having a plurality of connector contact springs and two pairs of outermost switch contact springs. These springs are located in essentially a side-by-side planar relationship with a pair of the switch contact springs located on opposite sides of the plane. The switch contact pairs are controlled depending on the width of an inserted plug. Inserted plugs are centered in the jack by a key slot. The body of a narrow width plug passes between the switch contact pairs while allowing contacts on the plug to connect electrically with the inner contact springs. The body of a sufficiently wide plug, on the other hand, physically operates the switch contact pairs during plug insertion. While the subject matter of this patent allows the selective activation of one or, perhaps two, different features, it is, however, inherently limited to no more than this capability.

SUMMARY OF THE INVENTION

A jack in accordance with the present invention improves the prior art by providing for the selective activation of additional options not allowed by the prior art. Prior art modular jacks include a plurality of connector contact springs arranged side-by-side in a plane with each connector contact spring extending rearwardly cantilever fashion within a plug-receiving opening. Outermost first and second switch contact springs located on opposite sides of the plane formed by the connector springs allow the activation of at most two options depending on the width of a plug inserted into the opening. Our improvement is characterized by at least one third pair of switch contact springs disposed outside of the plane formed by the connector and the first and second switch contact springs. This third pair of switch contact springs is controlled, independently of the control of the first and second switch contact springs, by the presence, or absence, of a protrusion on a sidewall of a plug. In addition, the first and second switch contact springs may still be controlled by the plug width.

DETAILED DESCRIPTION

Figure 1:
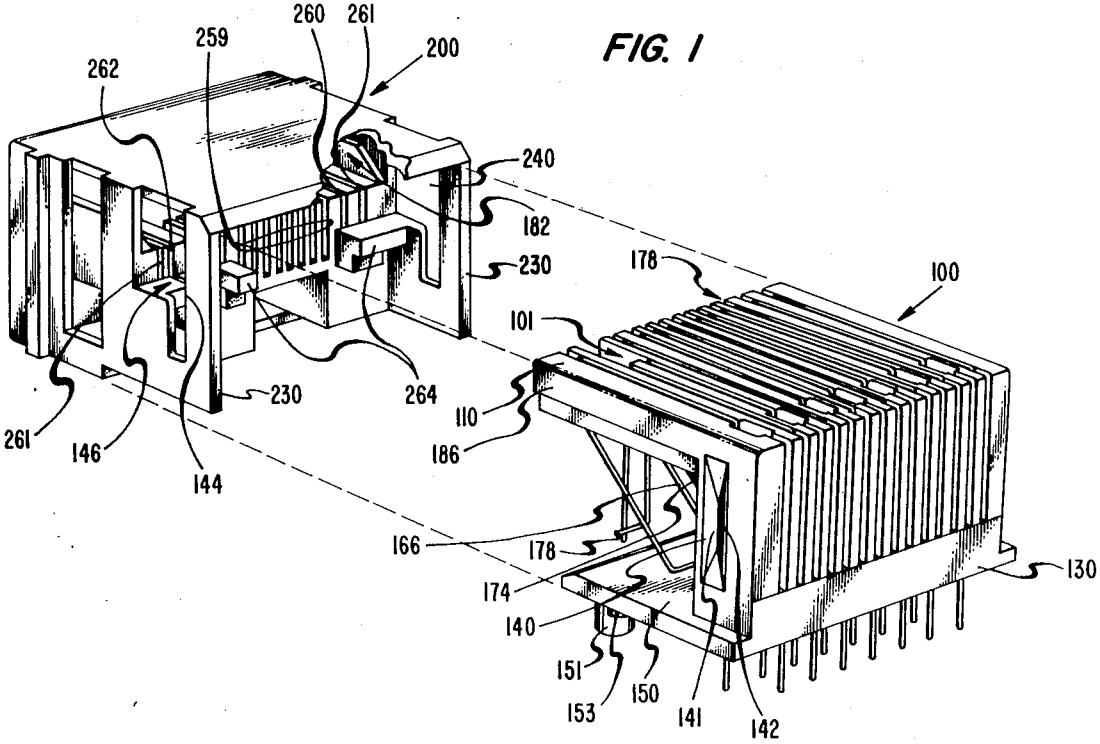
FIG. 1 is a perspective view of a modular jack in accordance with the present invention with the jack expanded to reveal a jack housing and a contact carrier which is received by the housing. This view shows portions of one outermost switch spring pair and some of the inner connector springs all of which are substantially located in the same place. In addition, in accordance with the invention, this view shows a third nonplanar contact spring pair.

Referring to FIG. 1 of the drawing, a jack in accordance with the present invention includes a unitary dielectric contact carrier 100 mounted within a unitary dielectric housing 200.

The dielectric contact carrier 100 illustratively comprises three rectangular walls: 130, 110, which is connected perpendicularly to one end of the wall 130, and 150, which is connected perpendicularly to the other end of wall 130. Wall 150 acts as a base of the carrier. Two opposite side edges of wall 130 have latches 140 (one being shown in FIG. 1) for securing the unitary dielectric contact carrier inside housing 200. The latch 140 has a wedge-shaped profile as noted in FIG. 1 and includes a trailing blocking surface 142 and a leading cam surface 141. Cam surface 141 assists the insertion of carrier 100 into the housing 200 and blocking surface 142 snaps behind a lip at 144 formed by a cutout 146 in a sidewall of housing 200.

The base wall 150 of the dielectric contact carrier has a pair of slotted cylindrical latches 151 and a pair of smaller cylinders 153 (see FIG. 5) extending perpendicular to the base to provide support when mounted to other apparatus.

Figure 2:
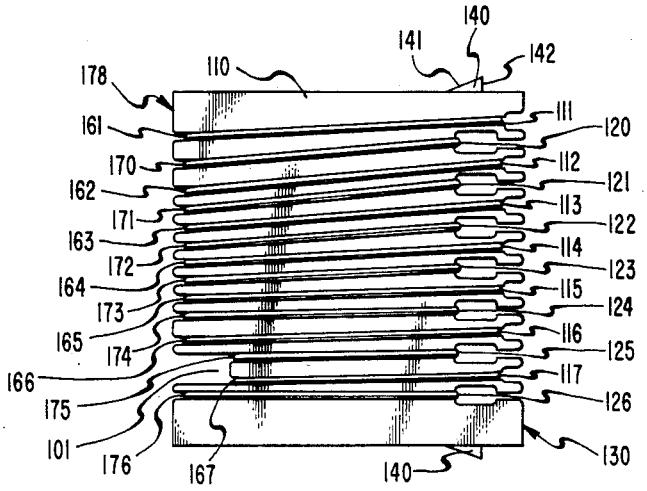
FIG. 2 is a top view of the contact carrier.
Figure 3:
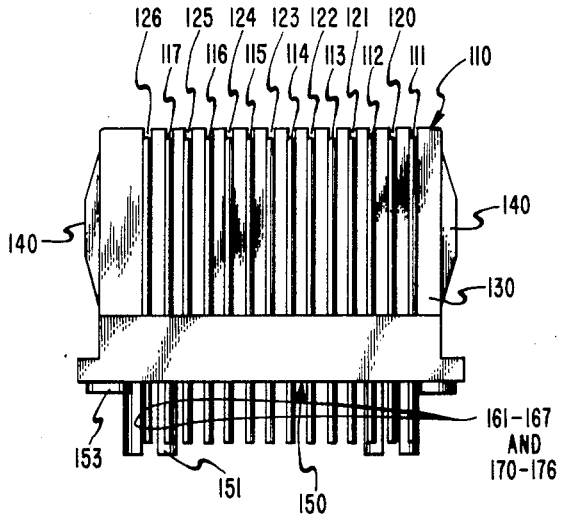
FIG. 3 is a rear view of the contact carrier.
Figure 7:
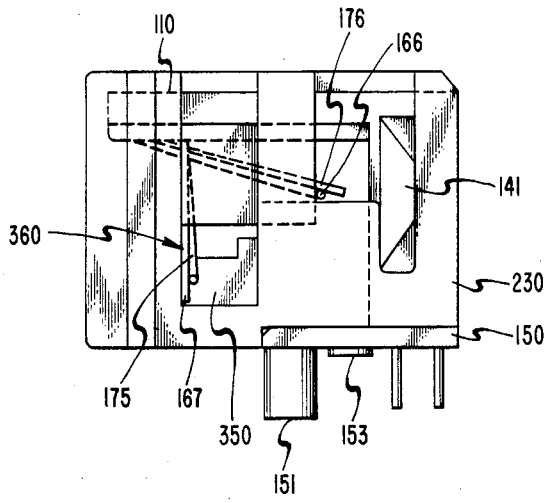
FIG. 7 is a side view of the assembled modular jack.

Referring to FIG. 2 and FIG. 3, walls 110 and 130 of the contact carrier 100 have a plurality of mating channels 111–117 and 120–126 for accommodating connector and switch contact springs 161 through 167 and 170 through 176, respectively. The connector and switch contact springs wrap around the free end 177 of the top wall 110 and follow the aforementioned channels in walls 110 and 130, finally emerging from orifices in the base wall 150 to provide electrical connection points that may be soldered into a printed circuit board, for example. Because of space considerations, the channels in wall 130 are staggered alternately (see FIG. 2), making an outermost row of channels consisting of 111 through 117 and an inwardly recessed row consisting of channels 120 through 126. The connector springs 162–165 and 171–174 wrap around the free end 177 of wall 110 and extend rearwardly in a cantilever fashion substantially in a plane, as shown in FIGS. 1 and 7, to form electrical contact areas with mating contacts on a plug. The outermost switch contact springs 161/170 and 166/176 are similarly configured so that a sufficiently wide plug will contact the inner springs (e.g., 166) of one or both of these switch spring pairs and electrically operate the respective switches.

Figure 4:
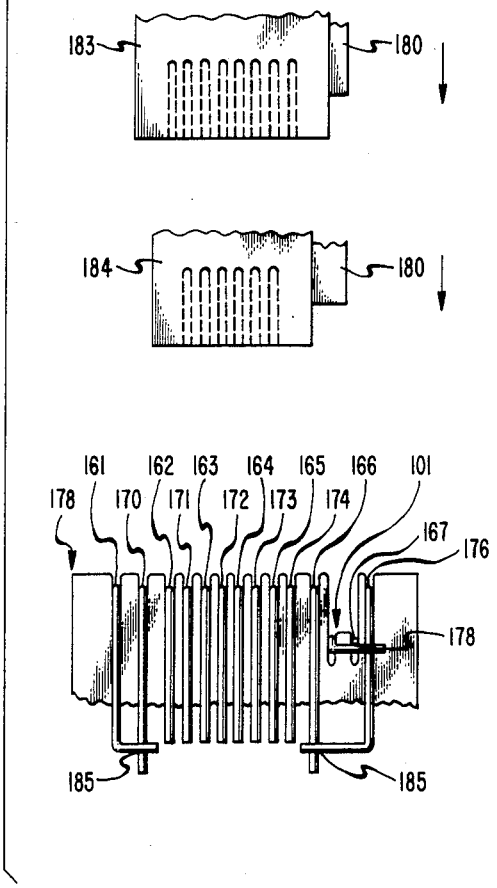
FIG. 4 shows a simplified bottom view of the contact carrier together with an indication of the relationships between plug widths and the first and second planar switch pairs, and a plug protrusion and the third nonplanar contact pair.
Figure 8:
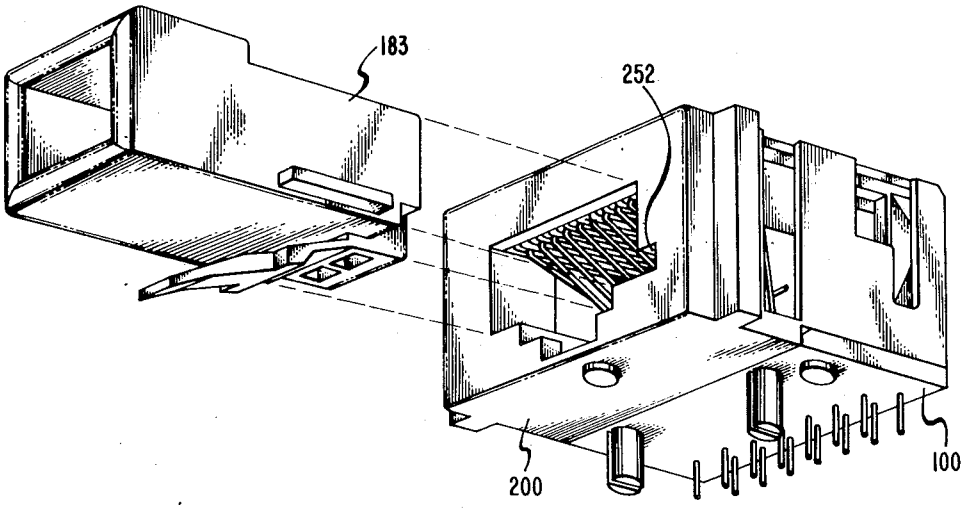
FIG. 8 is a perspective view of the assembled modular jack with a plug.

In accordance with an aspect of the invention, wall 110 contains two channels 117 and 125, which are recessed inwardly at cutout portion 101 from the free end 177 of the remaining channels in wall 110. Contact springs 175 and 167 are accommodated by these two channels. With reference to FIGS. 1 and 4 note that these contact springs 167, 175 extend downwardly after wrapping around the cutout portion 101 and form a normally closed switch contact 178. Springs 167, 175 forming contact 178 are therefore recessed rearwardly toward the wall 130 and extend in a different plane than that formed by the remaining connector and switch contact springs. FIG. 4 functionally shows the relationship between the springs 167, 175 forming contact 178 and a protrusion 180 located on a sidewall of a plug 183 or 184. A better view of the protrusions is obtained from FIG. 8 which shows a perspective view of the relationship between an assembled jack and a plug such as 183. When a plug having protrusion 180 is inserted into the jack, the protrusion physically contacts spring 175 (but not any other spring) and thereby opens the contact 178. How this is accomplished can be better seen with reference to FIG. 5. Protrusion 180 is received by a key slot 252 (discussed in more detail below) which exposes switch spring 175 for operation by the protrusion. Any plug accommodated by the jack may be equipped with a protrusion 180. However, a protruding dimension of the protrusion must be varied according to the width of the plug, as shown in FIG. 4, to operate contact 178. Contact 178 remains closed when any plug without protrusion 180 is inserted. Note also in FIG. 5 that the body of a sufficiently wide plug will physically contact springs 166 and 170, moving them upward as the plug is inserted to thereby operate the planar switch contact pairs independently of the operation of nonplanar contact 178. Note also that it is possible, subject to space considerations, to provide at least one additional nonplanar contact arranged as 178, but located on the opposite side of the contact carrier 100, and also operable or nonoperable by the presence or absence of an additional protrusion on the opposite sidewall of a plug. This then allows for selective control of at least four options or features based upon plug type, in addition to the one (or two) selective options associated with operation of the outermost planar switch contacts 185 (FIG. 4) under control of plug width.

The structrual details of the housing 200 and carrier 100 which allow the above-described connector and switch spring configurations are now further explained.

Figure 6:
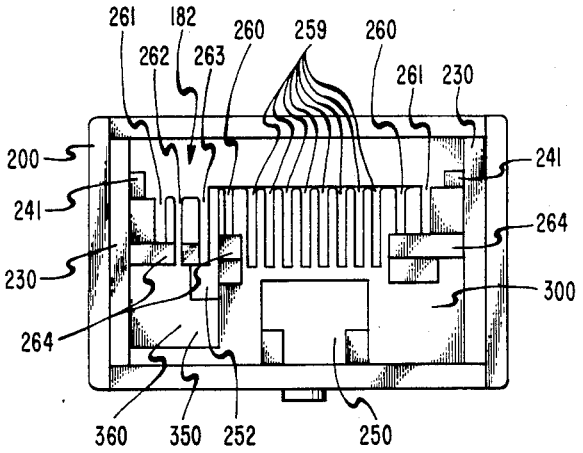
FIG. 6 is a view of the rear of the jack housing that receives the contact carrier.

Housing 200 contains a cavity 182 formed in part by external sidewalls 230 (FIG. 6) of housing 200. Cavity 182 receives the wall 110 of contact carrier 100 when the jack is assembled. Cavity 182 is shown in FIGS. 1 and 6. Recessed lips 186 (FIG. 1) on opposite sides of wall 110 of carrier 100 slide over members 241 (FIG. 6) in housing 200 to provide structural support of the assembled jack. The spacing between the facing surfaces of the sidewalls 230 in FIG. 6 is such that when carrier 100 is initially inserted into the housing 200, the sidewalls 230 are deflected outward by the cam surface 141 of the latch 140 on the carrier (FIG. 1). Then when the carrier 100 is moved to a position where the latch 140 is in registration with the opening 240 (FIG. 1), the sidewalls 230 return to their undeflected position behind latch 140 to secure the carrier inside the housing.

The switch and connector contact springs on carrier 100 are received and guided by slots 259 through 263, shown in FIG. 6 and partly in FIG. 1. Specifically, the outermost switch contact springs are guided by slots 260 and 261. The inner connector springs are guided by slots 259. In accordance with the invention, at the left interior of the housing in FIG. 6, the nonplanar switch springs 167, 175 are received and guided by slots 262 and 263. Both of these latter slots are open to a lower cavity 350 which accommodates the nonplanar springs and the contact 178 (FIG. 4) formed thereby.

Figure 5:
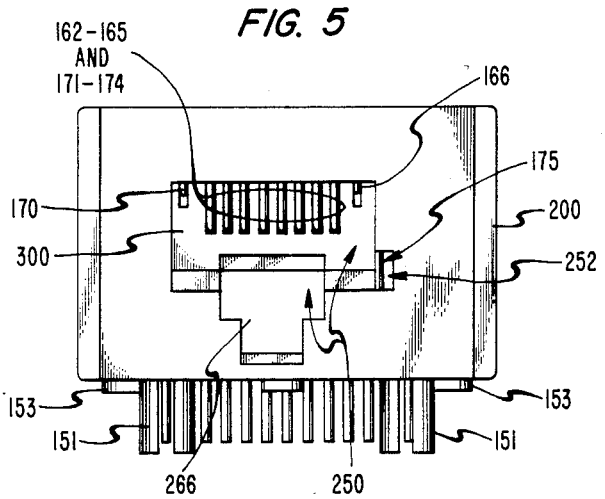
FIG. 5 is a front view of the modular jack housing.

Housing 200 also includes a plug-receiving cavity 250 in FIG. 5 that is open at the front of the housing 200. Cavity 250 also includes a key slot 252 which receives plug protrusion 180 (FIG. 4), if present. The rear of key slot 252 is open to the backside of the housing into which the carrier 100 is inserted. When the jack is assembled, spring 175 of the nonplanar spring contact pair is visible in key slot 252, as shown in FIG. 5, and accessible for movement by a plug protrusion 180.

The rear of the plug-receiving cavity 250 is defined by the opposite side of a wall 300 which contains the aforementioned slots 259–263 that receive and guide the connector and switch springs. The middle slots 259 are of uniform depth for properly positioning the connector springs 162–165 and 171–174 (FIG. 2). Slots pairs 260 and 261 are of more shallow depth and thereby act to bend the outermost switch springs more than the connector springs are bent. In addition, bosses 264 protruding from the back surface of the rear wall 300 push against springs 161 and 166 of the outermost planar switch springs of an assembled jack. The combination of the aforementioned smaller slots and the bosses 264 position the switch contact springs for operation by a sufficiently wide plug and exert a predetermined contact 185 force for proper electrical connection of closed contacts 185.

The position of the outermost planar contact springs 166, 176 and 167, and 175 of the nonplanar contact springs of an assembled jack may be better visualized from FIG. 7, which shows a side view of an assembled jack.

The nonplanar contact springs 167 and 175 are arranged so that spring 167 is deflected by a wall 360 of cavity 350 far enough to ensure electrical contact with a minimum predetermined force (approximately 30 milligrams) against spring 175. Wall 360 is shown in FIGS. 6 and 7.

Cavity 250 in FIG. 5 also includes a keyway 266 open to the front of the jack and which is centered between the side walls of cavity. The keyway 266 cooperates with a conventional latch (hidden in FIG. 8) on a plug to properly center the plug within the cavity. With this arrangement, the jack is adapted to mate with the plugs of different widths and with different numbers of contacts.

It is to be understood that the above-described arrangement is merely illustrative of the application of the principles of the invention and that other arrangements may be devised by those skilled in the art without departing from the spirit and scope of the invention.

What is claimed is:

1. A telephone jack having a housing (200) including a first cavity (250) for receiving complementary plugs (183, 184) of different sizes, the first cavity including a key slot (266) for receiving a protrusion (180) on a complementary plug;

a plurality of connector contact springs (162–165, 171–174) generally positioned in a common plane within the first cavity for engaging contacts of the complementary plugs;

a first and second pair of switch contact springs (161, 170), positioned in approximately the same plane as the connector contact springs, each pair including one contact spring that is biased against the other contact spring, the biased contact spring being deflected away from the other contact spring responsive to the insertion within the cavity of a complementary plug of a first size, and the biased contact spring remaining in engagement with the other contact spring upon the insertion within the cavity of a complementary plug of a second size; and the jack being characterized by a third pair of switch contact springs (167, 175) positioned in a substantially different plane from that of the plurality of connector contact springs and the first and second pair of switch contact springs, one contact spring of the third pair of switch contact springs being biased against the other contact spring of the third pair of switch contact springs, the biased contact spring being deflected away from the other contact spring responsive to the insertion within the first cavity of a plug having a protrusion received by the key slot, and remaining in contact with the other spring of the third pair of contact springs upon insertion of a complementary plug not having the protrusion.

2. A jack as in claim 1 wherein the housing further comprises plural internal wall members defining an internal second cavity (350) part of which communicates with the key slot in the housing, said second cavity being adapted for receiving contact portions of the third pair of switch contact springs and one of the third pair of switch contact springs being exposed for operation by the insertion of a plug having a protrusion accommodated by the key slot.

3. A jack as in claim 1 wherein the jack comprises a dielectric contact carrier having a first wall (110) connected to one end of a second wall (130), and the other end of the second wall in turn, being connected to a base wall (150);

the first wall and the second wall having a plurality of mating exterior first channels (111–117, 120–126) extending from a free end of the first wall to the other end of the second wall to accommodate the connector and switch contact springs, the connector and first and second pair of switch contact springs at one end extending around the free end of the first wall and then extending rearwardly toward the second wall, the connector and first and second pair of switch contact springs at the other end extending from the base wall to provide points of electrical connections to other apparatus, and the first wall including a cutout portion (101) at its free end for recessing the third pair of switch contact springs rearwardly toward the second wall with respect to the connector and first and second pair of switch contact springs.

4. The invention of claim 3 wherein the third pair of switch contact springs extend around the free end of the cutout portion and then downward substantially perpendicular to the base wall to place the third pair of switch contact springs both in a different location and a different orientation from the connector and first and second pair of switch contact springs.

5. A telephone jack comprising:

a housing having a cavity including a key slot for receiving complementary plugs of different sizes, some of which complementary plugs having a protrusion that is received by the key slot;

a plurality of connector contact springs positioned within the cavity for engaging contacts of the complementary plugs;

first and second pairs of switch contact springs positioned within the cavity adjacent to the connector contact springs, each pair including one contact spring that is biased against the other contact spring, the biased contact spring being deflected away from the other contact spring responsive to the insertion within the cavity of a complementary plug of a first size, and the biased contact spring remaining in engagement with the other contact spring upon the insertion in the opening of the complementary plug of a second size; and a third pair of switch contact springs positioned adjacent to the plurality of connector contact springs, one spring of the third pair of switch contact springs being biased against the other spring of the third pair of switch contact springs, the biased contact spring being deflected away from the other contact spring responsive to the insertion within the cavity of a plug having a protrusion that is received by the key slot, and remaining in contact with the other spring of the third pair of contact springs upon insertion of a plug not having such a protrusion.

6. A telephone jack comprising:

a housing having a cavity for accommodating a complementary plug inserted into the cavity, and having a key slot to a side of said cavity for receiving a protrusion that is a discontinuity of and projects outwardly from a surface of the plug;

a plurality of connector contact springs positioned within the cavity for engaging contacts of the complementary plugs, the connector contact springs extending into the cavity from a first location; and a pair of switch contact springs positioned within the cavity adjacent to the plurality of connector contact springs, the switch contact spring pair being substantially displaced from the first location of the connector contact springs relative to the direction of plug insertion, the switch contact spring pair extending adjacent to the key slot and being operated responsive to the insertion within the cavity of the plug having the protrusion that is received by the key slot.

7. A telephone jack as in claim 6 wherein the connector contact springs are generally positioned in a common plane within the cavity and the switch contact spring pair is positioned within the cavity in a substantially different plane from the common plane of the connector contact springs to place the switch contact spring pair in both a substantially different orientation and a substantially different location from that of the connector contact springs.

8. A telephone jack as in claim 6 wherein the connector contact springs extend rearwardly from an entrance to the cavity of the housing while the switch contact spring pair extends generally parallel to the entrance of the cavity to place the switch contact spring pair in both a substantially different orientation and a substantially different location from that of the connector contact springs.

9. A telephone jack as in claim 6 wherein the second location of the switch contact spring pair is displaced from the first location of the connector contact springs in the direction of plug insertion.

10. A telephone jack as in claim 9 wherein the connector contact springs extend rearwardly from an entrance to the cavity of the housing while the switch contact spring pair extends generally parallel to the entrance of the cavity to place the switch contact spring pair in both a substantially different orientation and a substantially different location from that of the connector contact springs.

* * * * *